US006845594B2

(12) United States Patent
Harber

(10) Patent No.: US 6,845,594 B2
(45) Date of Patent: Jan. 25, 2005

(54) PRE-MANUFACTURED JOIST AND BEAM SUPPORT FOR CONCRETE WALLS

(76) Inventor: Jerome A. Harber, 302 West Mission P.O. Box 181, St. Marys, KS (US) 66536

( * ) Notice: Subject to any disclaimer, the term of this patent is extended or adjusted under 35 U.S.C. 154(b) by 0 days.

(21) Appl. No.: 09/825,429

(22) Filed: Apr. 3, 2001

(65) Prior Publication Data

US 2001/0034993 A1 Nov. 1, 2001

Related U.S. Application Data

(60) Provisional application No. 60/196,633, filed on Apr. 12, 2000.

(51) Int. Cl.[7] ..... E04B 1/38; E04C 5/00

(52) U.S. Cl. ..... 52/702; 52/712; 52/714; 52/715; 52/289

(58) Field of Search ..... 52/702, 289, 255, 52/309.12, 252, 698, 712, 714, 715, 699; 403/232

(56) References Cited

U.S. PATENT DOCUMENTS 4,353,664 A * 10/1982 Gilb ..... 52/289
4,982,548 A * 1/1991 Abbey ..... 52/702
5,228,261 A * 7/1993 Watkins ..... 52/702
5,307,603 A * 5/1994 Chiodo ..... 52/698
5,467,569 A * 11/1995 Chiodo ..... 52/713
6,131,358 A * 10/2000 Wise ..... 52/702
6,463,711 B1 * 10/2002 Callies ..... 52/702

FOREIGN PATENT DOCUMENTS

GB 2047320 * 2/1980 ..... E04C/5/18
GB 2185047 * 12/1985 ..... E04B/1/40

* cited by examiner

*Primary Examiner*—Carl D. Friedman
*Assistant Examiner*—Chi Q Nguyen
(74) *Attorney, Agent, or Firm*—Bruce J. Clark

(57) ABSTRACT

A pre-manufactured joist and beam support for concrete walls to be poured, particularly those utilizing a permanent, secondary non-structural material as forms essentially adjacent to the concrete, comprised of a U shaped rigid member, rigid anchor members extending therefrom and so as to cause a sufficiently large hole to be created in the secondary material in which the support is inserted and which essentially does not interfere with the flow of concrete being poured.

10 Claims, 7 Drawing Sheets

PRE-MANUFACTURED JOIST AND BEAM SUPPORT FOR CONCRETE WALLS

This application claims the benefit of U.S. Provisional Application No. 60/196,633 filed Apr. 12, 2000.

BACKGROUND OF INVENTION

The present invention relates to the art of construction, in particular in connection with the integration of joist and beam supports with poured concrete walls, and more particular, those concrete walls utilizing insulated concrete forms.

In the construction of buildings, residential or commercial, concrete walls are poured utilizing forms secured in place and between which the concrete is poured. Insulated concrete forms are those premanufactured forms made of sturdy spaced apart essentially planar insulating members (usually polystyrene material, commonly called styrofoam) premanufactured as a unit (in blocks, planks or panels) held together in a spaced apart fashion utilizing plastic or metal form ties. Insulated concrete forms coming in double paneled blocks, for example, are placed one on top of the other to create a double formed wall in which the concrete is poured, to create, upon curing of the concrete, not only a sturdy concrete wall, but an insulated one as well.

This method of construction presents unique problems associated with securing the next higher floor's flooring system as it connects to the top of the concrete wall. This problem exists because most insulated concrete forms are utilized with multi-story concrete walls that comprise a continuous concrete wall from story to story. Thus, some method of installing joist or beam hangars, or the like, is necessary to incorporate into the concrete wall as it is being built. However, even in those buildings utilizing concrete walls on one level only, or those utilizing stay-in-place concrete forms, an easy to use sturdy joist hanger built into the concrete wall is desirable. It should be understood that although the terms joist and beams are utilized, the invention envisioned herein addresses problems associated with supporting the ends of any elongated support member, including trusses and the like.

The existing art, such as that shown in Watkins, U.S. Pat. No. 5,228,261, utilizes a multi-part device utilizing a continuous U shaped element held in place utilizing insertable/removable horizontal rebars; moreover, it requires a fairly time consuming task of cutting a specific U shaped design into the insulation material to match as closely as possible the shape of the U shaped member. Moreover, such a hangar allows for as much as 2 to 3 inches of what is essentially open space between the concrete and the end of the joist member being supported so as to create an undesirable bending moment creating significant bending stress about the edge of the concrete wall where the device meets the concrete wall. This bending moment has both horizontal and vertical forces, the horizontal forces of which are undesirable. It also necessitates time and labor in tying such a device to the existing rebar structure of the concrete. Moreover, such a device is obtrusive in terms of concrete flow inside the wall during pouring, and consequently provides an impediment in a smooth concrete flow and further provides opportunities for concrete integrity challenging air pockets to develop on the underneath sides of the channel member inside the wall.

Ledger boards are also sometimes used in place of hangars. These ledger boards are secured to the concrete wall during construction, but do not rest on the concrete wall as is the preferred method in typical wood frame construction. Consequently, ledger boards which are not only time consuming to install and connect to the joist, provide the weak point of contact between the floor, floor joist and concrete wall, there being no floor joist resting on a concrete wall or metal hangar secured in the concrete wall. Moreover, the ledger board is subject to shifting inasmuch as construction requires a large number of holes to match up with concrete supported bolts, a difficult to achieve task that usually results in larger than necessary holes in the ledger board creating tendencies for shifting and for weakness in the board. Moreover, ledger boards allow for risks of rot and termite infestation and shrinkage in dry climates, all undesirable elements for key structural members.

The present invention provides a minimal amount of structure to interfere with the concrete flow, yet provides a self-contained rebar arrangement in the preferred form. It also allows a unique and quick attachment to the vertical rebars if desired. It also provides an easy to construct back T-bar plate to achieve the desired objectives and has means for easily attaching to the existing furring strips that are integral to the insulated concrete form to provide a method for securing and holding the device during the rigors of concrete pouring, and also, in an alternative mode, allows for maintaining the placement of the hangar during the shifting of the forms that sometimes occur during pouring.

Thus the present invention is a sturdy, single part hangar that is quick and easy to install that is designed in the preferred mode to "connect" to an existing vertical rebar, if needed, or can be utilized without the rebar at the discretion of the builder, and provides for a device having a back plate member, and further is designed so as to allow a direct contact between the back plate and the concrete structure so as to disallow bending forces on the device and so as to further minimize any horizontal forces that would pull the hangar away from the wall. It is an inexpensive, easy to construct, solid single unit hangar member that can be easily intertwined with the vertical reinforcing bar members of the concrete wall if desired, and that provides for flush contact between the vertical face of the hangar and the concrete associated with the wall.

Moreover, it provides for clean connections and abutments, easily allows for beams placed at an angle such as those adjoining the wall at a 45 degree angle and allows for full concrete flow in and around the device to minimize, and essentially eliminate, air pockets of concrete that would otherwise be caused by the presence of the device.

Additional objects and features of the invention and the manner in which the invention achieves its purpose will be appreciated from the foregoing and the following description and the accompanying drawings which exemplify the invention, it being understood that changes may be made in the specific method and apparatus disclosed herein without departing from the essentials of the invention.

DESCRIPTION OF THE PREFERRED EMBODIMENT

Figure 1:
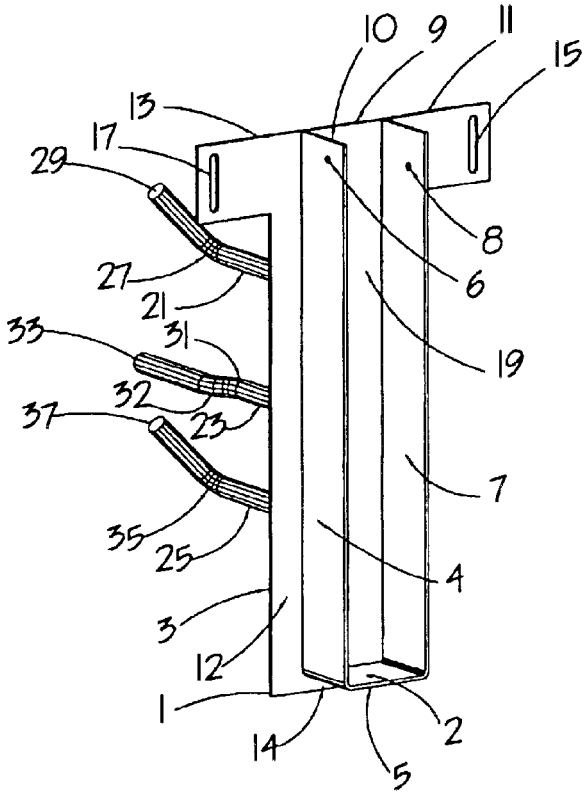
FIG. 1 is a front view perspective of the preferred embodiment of the invention.

The invention is shown in the preferred mode in FIG. 1 having a U shaped channel member composed of a first elongated vertical essentially planar member 4 in essentially parallel relationship to second essentially planar member 7, having a bottom 5 there between. Back plate 9 is attached to the U shape member at its rear edges, and is essentially in its preferred mode a rigid planar T shaped member having extended wing sections 11 and 13, and further has a front face 19. This T shaped member 9 also is slightly larger than the U shaped channel member to create a side lip 12 having outer edge 3 and a corresponding opposing side lip next to the vertical wall 7 (not shown) and further creates a bottom lip 14, discussed later.

Bottom 5 has hole 2 that allows for screw, nail or other securing means to be inserted into the joist once the joist is placed in the channel member. For ease of reference throughout this specification and claims, "joist" will be used to include any floor supporting members such as joist, beams and trusses. Vertical member 7 has hole 8 as does vertical member 4 have hole 6. These holes, 6 and 8, are also for allowing screw, nail or other connection means to be placed therein to secure the joist in place. Wings 11 and 13 have elongated holes 15 and 17 respectively, essentially vertical in position, so as to allow for screw, nail or other securing means to hold the hangar 1 in place prior to and during pouring of the concrete. These screws and/or nails extend into the styrofoam and through the furring strips contained within the styrofoam. These furring strips are usually comprised of plastic or other solid material for the very purpose of securing construction materials to the styrofoam wall. The holes 15 and 17 are slotted so as to allow the slight movement of the insulated concrete form in response to the weight and pressures of the wet concrete, yet maintain the desired position of the hangar. This desired position is achieved, as will be seen, by utilizing external means such as vertical studs or other supports secured in place underneath the hangar. Thus, the external stud or board maintains the hangar in place while the wall and nails protruding through slots 15 and 17 moves up and down inside the slots 15 and 17. In the alternative mode of the invention, multiple slots parallel to slots 15 and 17 are placed in the wings to allow for various brands and manufacturers of the concrete forms that have differing placement of the furring strips throughout.

Hangar anchors 21, 23 and 25 are shown and provide the means for securing the device to the concrete wall. Although various arrangements are envisioned, in the preferred mode, the top hangar anchor 21 and bottom hangar anchor 25 have identical essentially perpendicular bends 27 and 35. Consequently each of the top and bottom hangar anchors has two sections, a first section that is essentially perpendicular to and attached to the rear side of the face plate 9, and a second section perpendicular to the first section, terminating at ends 29 and 37 respectively. Middle hangar anchor 23 has two 45 degree bends, 31 and 32 to create a three-section elongated member, a first perpendicular section a second section at a 45 degree angle and a third section essentially parallel to the first section.

Figure 2:
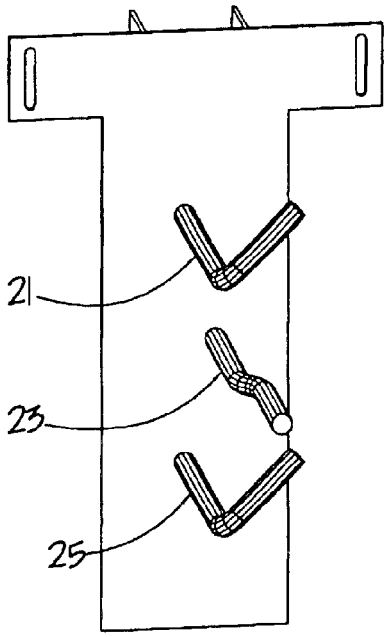
FIG. 2 is a rear view perspective of the preferred embodiment of the invention.
Figure 3A:
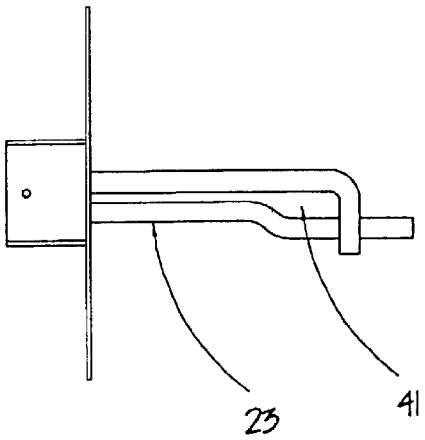
FIG. 3*a* is a top view of the invention.
Figure 3B:
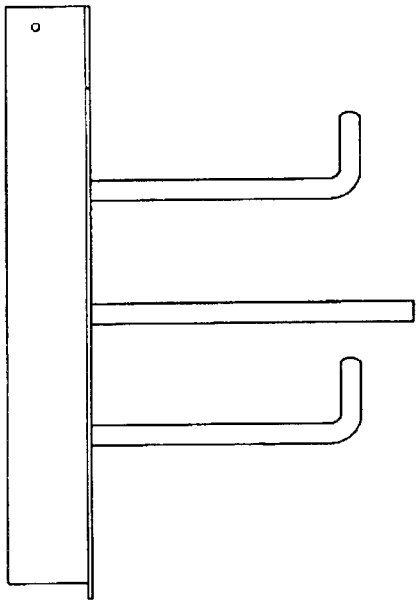
FIG. 3*b* is a side view of the invention.

These three hangar anchors are shown attached to the rear of the face plate 9 in FIG. 2. Although not required, the hangar anchors 21, 23 and 25, in the preferred mode, are attached (welded) inline, i.e. along the same line, essentially at the center of the rear of the face plate. However, the arrangement of the three hangar anchors is such that an opening 41 in FIG. 3*b* is created through which the vertical reinforcing rod for the concrete wall at that location in the wall is placed. This can be more easily seen in FIG. 4. The hangar anchors are shown in the preferred mode placed equal distances apart, however, other non-equal distances are envisioned.

Figure 3C:
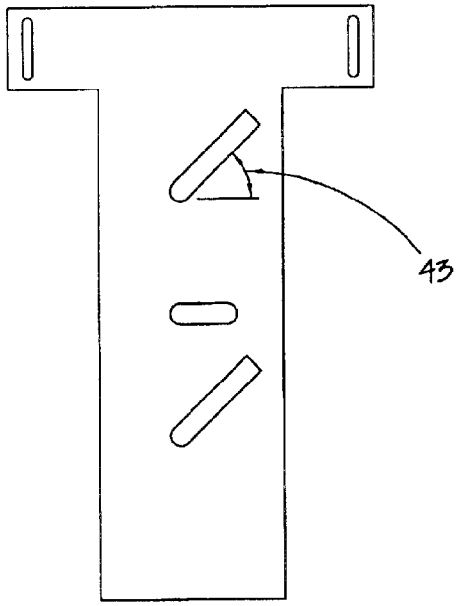
FIG. 3*c* is a rear view of the invention.

FIG. 3*b* shows a side view of the hangar with the three hangar anchors extending essentially perpendicular therefrom. It should be noted that FIG. 3*b*, although purporting to show the second section of the top and bottom hangar as pointing up, these are actually placed at an angle so as to allow them to "connect" or "retain" the vertical reinforcing rod, as more clearly shown in the rearview FIG. 3*c*. The top view in FIG. 3*a* shows the respective bend in the middle hangar anchor 23. In FIG. 3*c*, the rearview, it will be seen that the top and bottom hangars 21 and 23 are in fact placed at essentially a 45 degree angle. The middle hangar anchor, is added in the preferred mode, and adds strength and helps hold the hangar in place against the rebar, to avoid sideways shifting.

Figure 4:
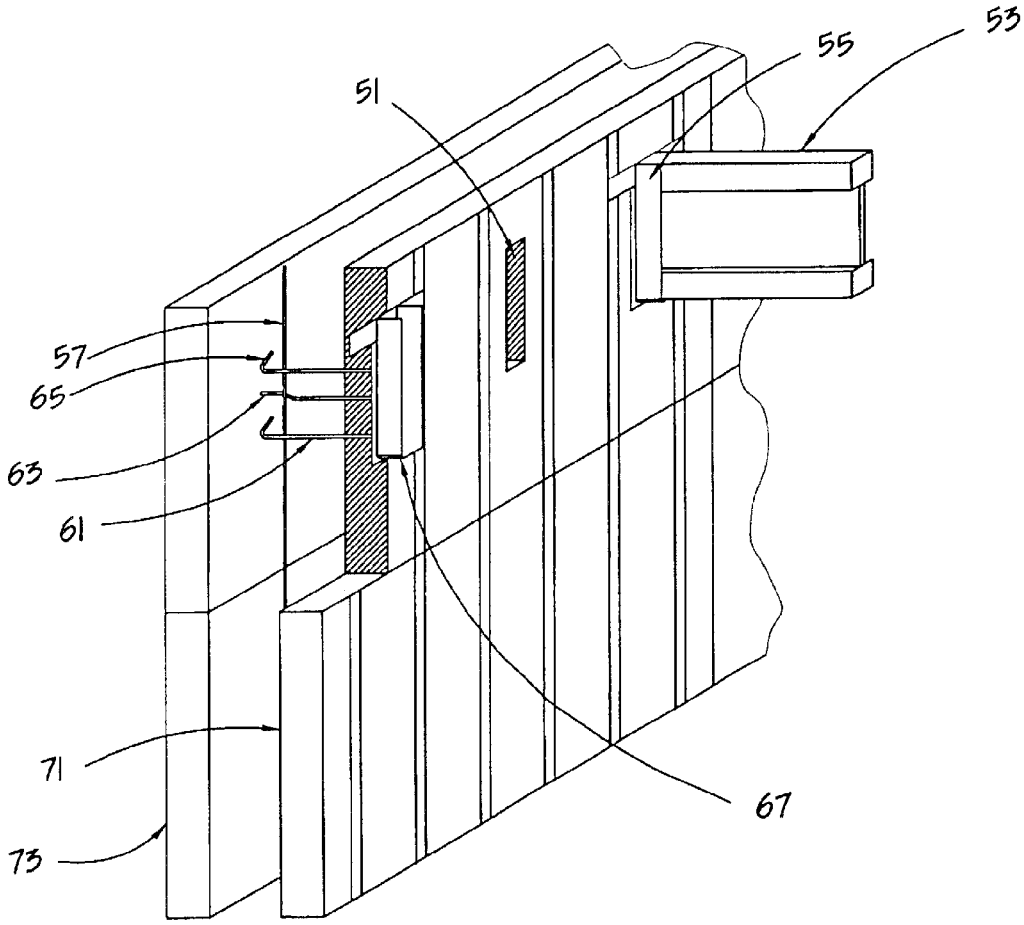
FIG. 4 is a perspective view of the invention in place on an insulated concrete formed wall.

While the hangar anchors as shown in the preferred mode act as a unique and efficient way to tie in to the vertical reinforcing bar, it should be noted that the overall arrangement of the invention reduces the need to actually do so inasmuch as it will be seen that in use, a hole is cutout in the insulation to allow concrete to flow up to the back plate thus creating a flush contact between the invention and the concrete that would not otherwise exist as a result of the presence of the insulation shown in FIG. 4, thus nearly eliminating the horizontal force placed on the device, i.e. nearly eliminating the bending moment. This, in combination with the unique shapes of the hangar anchors minimizes the need to tie into the vertical reinforcing rod. Nevertheless, tying into the vertical reinforcing rod in this manner provides a stronger and more secure installation.

Figure 5A:
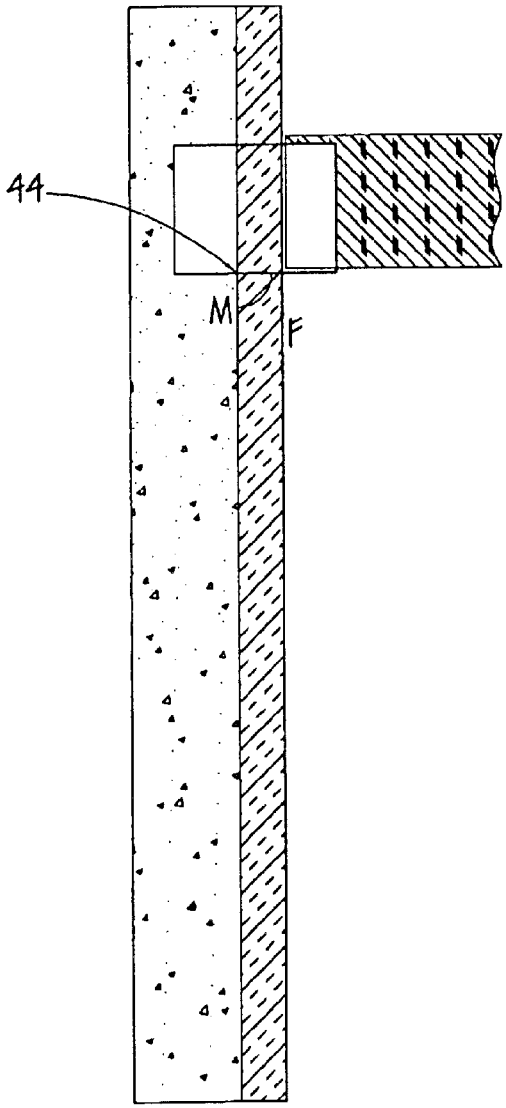
FIG. 5*a* shows a currently used hangar in place.
Figure 5B:
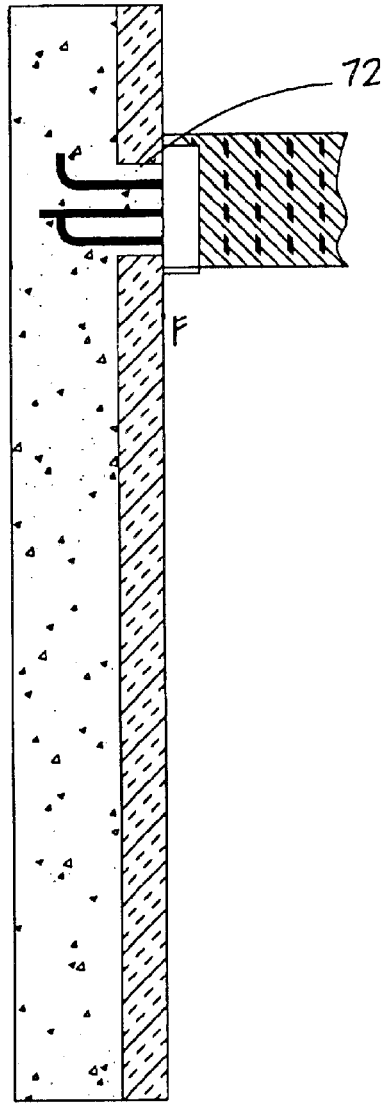
FIG. 5*b* shows the invention in the preferred mode, in place.
Figure 5C:
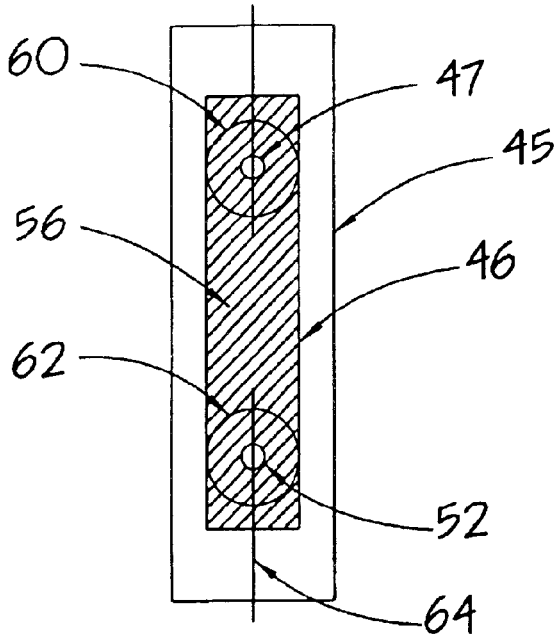
FIG. 5*c* shows a back view of the plate and the desired full flow of concrete surrounding the hangar anchor.

This is more clearly shown in FIGS. 5*a*, 5*b*, 5*c* and 5*d*. FIG. 5*a* shows a method currently used inserting a U shaped rigid member through the styrofoam form into the area where concrete has been poured. Thus, it can be seen in FIG. 5*a* that not only is a down force F present with the support of the beam, but also there is present a moment force M about point 44 caused by the presence of the form between the concrete wall and the beam. FIG. 5*b* shows the invention in the preferred mode. It can clearly be seen that the invention provides for a concrete extension 72 of the wall that is formed and allows for the back plate to have solid contact with the concrete of the wall, and allows each of the contact points of the rigid extensions to be surrounded by concrete. This can be more easily seen in FIGS. 5*c* and 5*d*. In FIG. 5*c*, the back plate 45 is shown with the hole cutout area identified as perimeter 46 in which the concrete 56 flows. It can be seen that the concrete surrounds fully the contact points of the rigid extension members 47 and 52. In FIG. 5*b*, it can be seen that the moment is nearly eliminated because of the presence of the concrete all the way up to and fully surrounding the contact points of the rigid extensions.

Figure 5D:
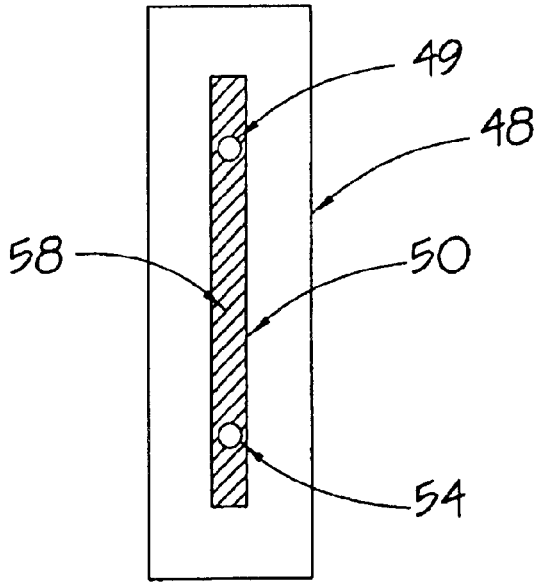
FIG. 5*d* shows the situation, contrary to FIG. 5*c*, where too small a hole is cut, preventing full flow of concrete around the hangar anchor.

In FIG. 5*d*, the situation is shown where a contractor might otherwise cut the hole 50 smaller than is required, intentionally or accidently. In such a situation, where the hole is not sufficiently large, it can be seen in FIG. 5*d* that the concrete in the hole 58 does not fully surround the contact points 49 and 54. This creates the distinct possibility that the minimal amount of concrete surrounding the contact points will chip or break away or in some cases not even exist because of an air pocket underneath the contact point, thus creating the very bending moment M that should be nearly eliminated otherwise. In the preferred mode of the invention, the extensions are placed so as to enhance the possibility that there is full concrete flow around the contact points 47 and 52 in FIG. 5*c*. This minimum area of coverage is shown as the dashed circle 60 and 62 in FIG. 5*c*, although as will be seen in practice, the concrete will likely fill in the entire hole represented by the dashed perimeter 46.

The invention accomplishes this in the preferred mode by providing that the contact points of the extensions are essentially in a linear form as represented by the vertical dashed line 64 in FIG. 5*c*. Placing them other than inline, for example near the perimeter of the hole 46, enhances the possibility that there will not be full flow of concrete around the contact point. The bends in the extensions not only provide means for "retaining" the extensions around the vertical rebar in the wall, but also require that the hole 46 be cut large enough to insert the device through the styrofoam form. In other words, as previously indicated, the contractor utilizing the device has no choice but to cut the holes large enough and by so doing, helps assure full flow of the concrete around the contact points.

Figure 6:
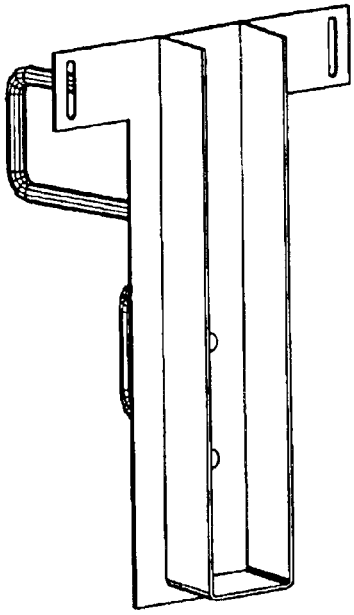
FIG. 6 shows an alternative mode of the invention from a front perspective.
Figure 7:
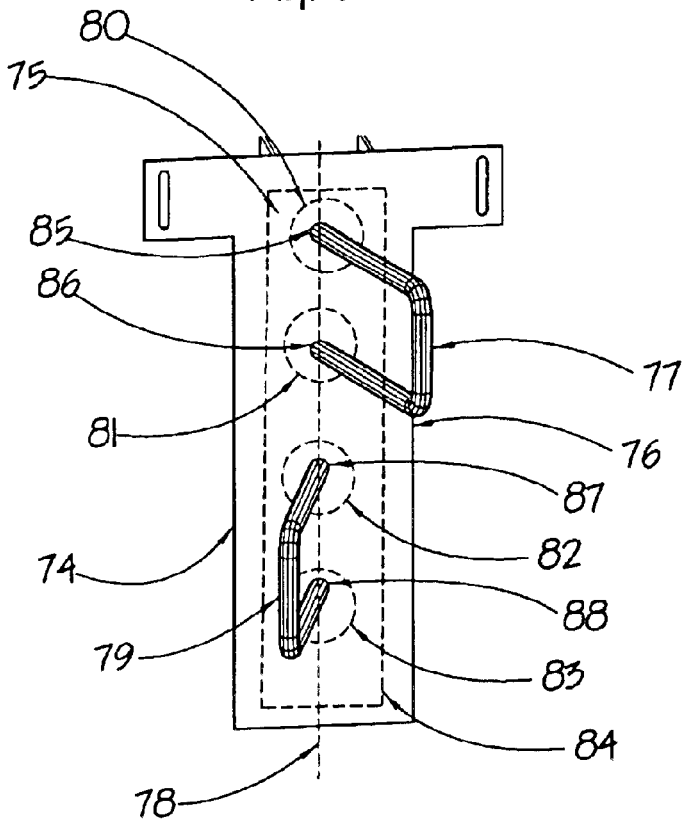
FIG. 7 shows the alternative mode of the invention in FIG. 6, but in a rear perspective view.

In another mode of the invention, shown in FIGS. 6 and 7, the rigid extension means attached to the back plate are comprised of at least two rigid extensions extending in opposite directions. As shown, first rigid member 77 is comprised of a U shaped rigid rebar member attached to the back plate 75 at a first angle with relation to the back plate 75. Second rigid extension means 79 are likewise comprised of a U shaped rigid rebar member attached to the back plate 75 at a second angle with relation to the back plate. The first and second U shaped extension means are, in the preferred mode, attached (welded) to the back plate, as in the other modes of the invention, inline as referenced by dotted line 78. However, as with the other modes, this inline attachment is not critical, but provides additional advantages.

Figure 8:
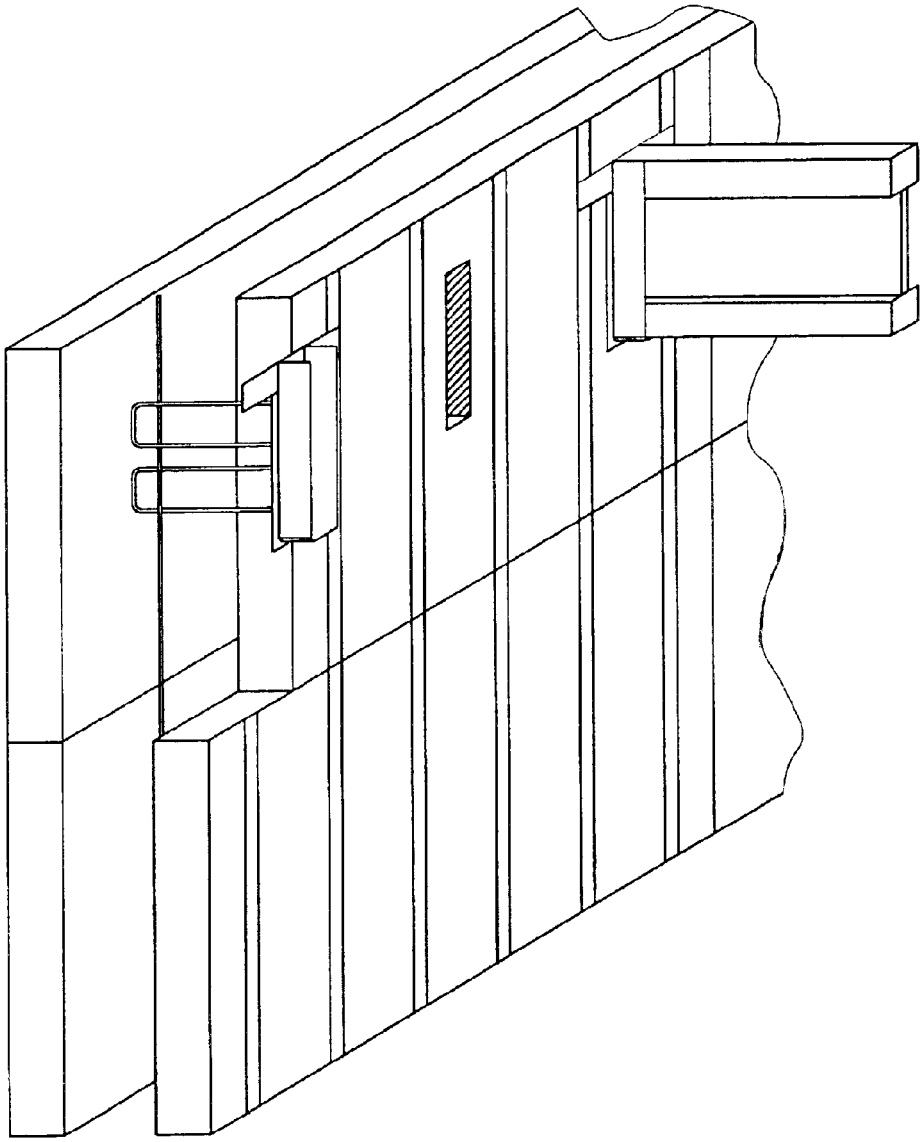
FIG. 8 shows the alternative mode in place on the wall.

The angles of the first and second extensions are opposite and equal angles in the preferred mode. Although other angles, and in fact no angle is possible to achieve the primary objectives of the invention. However, by angling them in the fashion shown, such that the base portion of each U shaped member approaches the imaginary perpendicular extension of the respective edges of the back plate (76 and 74) without actually extending the complete distance, requires that the hole created in the insulation form for the hangar be of sufficient size to allow the creation of a sufficient concrete extension into the hole (concrete extension 72 in FIG. 5*b*) to allow the concrete to flow fully around each of the points of contact between the U members and the base plate as shown by each of the dotted lined circles 80, 81, 82 and 83 (shown as approximations only). In practice, the concrete will flow closer to the shape of a hole represented by dotted line 84. This mode of the invention is used in the same manner as the prior mode although the rebar is placed between the two rigid oppositely angled extensions; moreover, the placement of these extensions forces contractors who might otherwise cut smaller holes in the forms to cut the hole large enough to hold a sufficient amount of concrete to assure that a sufficient amount of concrete is forced within the circles 80, 81, 82 and 83 to achieve a desired sufficient contact, not only between the back plate and the concrete, but also so that the rebars are fully surrounded by concrete where they make contact with the back plate so as to place them in shear so as to minimize the stress at the contact points 85, 86, 87 and 88. FIG. 8 shows the alternative mode of the invention in place with the two U shaped extensions on opposing sides of the vertical rebar.

While different features are envisioned and highlighted, and various modes of the invention are envisioned, it is important that the invention have not only a U shaped member for supporting the joist, but that it have a back plate, means for securing the back plate to the form and rigid extension means attached to the back plate for anchoring the hangar in the concrete; moreover, in the preferred mode, the extension means are attached to the back plate at contact points and are placed so as to assure that concrete flows substantially around all sides of each contact point at the back plate so as to nearly eliminate the bending stresses associated with the contact points.

To utilize the hangar and the preferred process mode of the invention, marks for placement of the hangars are made on the form 71 in FIG. 4. Holes 51 are then cut. These holes are cut slightly smaller than the vertical portion of the back plate (9 in FIG. 1). The hangar is then secured to the form. In the preferred mode, the hangar back plate is secured to the form by screwing, nailing or otherwise fastening the hangar to the furring strips inside the styrofoam utilizing holes 15 and 17 as discussed earlier. In the most basic form the process, concrete is then poured in the wall and up to the back plate of each hangar.

However, in the preferred process, prior to pouring concrete, vertical reinforcing bar 57 is placed between the hangar anchors 61, 63 and 65 and therefore rests between the inside insulation wall 71 and the outside insulation wall 73. Thus the hangar anchors are essentially retained also by the vertical reinforcing bar 57.

The hangars may also be secured either with or without fasteners (although in the preferred mode, with fasteners) by securing them from underneath utilizing wooden studs propped up against the hangar, and preferably the lower lip of the back plate, so as to push the back plate against the form and to secure the hangar against any vertical movement of the hangar. The opposite end of the stud is secured to the ground.

Once the concrete is poured into the area between the front and back walls 71 and 73, it is advisable to then check, while the concrete is wet, to assure all hangars have retained their desired placement of their desired positions, adjustments can be made at this time.

When the concrete is sufficiently cured, the joist 53 is set in place and secured utilizing screws or other securing means through holes 2, 6 and 8 in FIG. 1.

While there have been shown and described particular embodiments of the invention, it will be obvious to those skilled in the art that changes and modifications may be made without departing from the invention or its equivalent and it is intended by the claims to cover all such changes and modifications as fall within the true spirit and scope of the invention.

I claim:

1. A pre-manufactured joist and beam support for concrete walls to be poured utilizing a permanent, secondary non-structural material as forms essentially adjacent to the concrete, and wherein said non-structural material is capable of having receiving holes cut therein for receiving the joist support, comprised of:

a. an essentially U shaped rigid member having two opposing sides and a bottom, a front side and a back side, a rigid planar member as concrete retention means attached to said U shaped rigid member on the back side so as to create a U shaped interior having two opposing sides, a bottom, and a back, and an open front side of the U shaped member opposite the back, for allowing insertion and supporting of a joist;

b. concrete retention means connected to the U shaped member to allow concrete to flow flush with said retention means while preventing the concrete from flowing into the interior during pouring of the concrete;

c. means for securing the U shaped member in place prior to pouring of the concrete;

d. concrete anchoring means for anchoring the U shaped member to the concrete to be poured wherein said anchoring means and U shaped support essentially do not interfere with the flow of concrete being poured into the wall.

2. The premanufactured joist and beam support in claim 1 having means for inducing the creation of an opening in the non-structural material by an installer so as to assure a substantial portion of the back plate is exposed directly to the concrete.

3. The pre-manufactured joist and beam support in claim 2 wherein the means for inducing the creation of an opening are comprised of at least one rigid elongated anchor member attached to, and extending from, the concrete retention means and having bends therein so as to induce the creation of the sufficiently large opening in the non-structural material when installing the support.

4. The pre-manufactured joist and beam support in claim 1, 2 or 3 wherein the concrete retention means is a back plate member that is slightly larger than the U shaped member on at least two sides to create lips, and wherein the lips have hole means therein for holding securing means for securing the support to support holding straps in the non-structural material.

5. A pre-manufactured joist and beam support for concrete walls to be poured utilizing a permanent, secondary non-structural material as forms essentially adjacent to the concrete, and wherein said non-structural material is capable of having receiving holes cut therein for receiving the joist support, comprised of:

a. an essentially U shaped rigid member having two opposing sides and a bottom, a front side and a back side, a rigid planar member as concrete retention means attached to said U shaped rigid member on the back side so as to create a U shaped interior having two opposing sides, a bottom, and a back, and an open front side of the U shaped member opposite the back, for allowing insertion and supporting of a joist;

b. concrete retention means connected to the U shaped member to allow concrete to flow flush with said retention means while preventing the concrete from flowing into the interior during pouring of the concrete;

c. means for securing the U shaped member in place prior to pouring of the concrete;

d. concrete anchoring means for anchoring the U shaped member to the concrete to be poured wherein said anchoring means and U shaped support essentially do not interfere with the flow of concrete being poured into the, comprised of at least two elongated rigid members each having an end attached to the concrete retention means, and having an opposing end, and where at least one opposing end is bent in a different direction than the others.

6. The premanufactured beam and joist support in claim 5 having means for inducing the creation of an opening in the non-structural material by an installer so as to assure a substantial portion of the back plate is exposed directly to the concrete.

7. The pre-manufactured joist and beam support in claim 6 wherein the means for inducing the creation of an opening are comprised of at least one rigid elongated anchor member attached to, and extending from, the concrete retention means and having bends therein so as to induce the creation of the opening in the non-structural material when installing by an installer so as to assure a substantial portion of the back plate is exposed directly to the concrete.

8. The pre-manufactured joist and beam support in claim 5 wherein the bends in the elongated rigid member are bent so as to allow a vertical reinforcing bar to be situated within the bends.

9. The pre-manufactured joist and beam support claim 6 wherein the bends in the elongated rigid member are bent so as to allow a vertical reinforcing bar to be situated within the bends.

10. The pre-manufactured joist and beam support in claim 7 wherein the bends in the elongated rigid member are bent so as to allow a vertical reinforcing bar to be situated within the bends.

* * * * *